United States Patent [19]

Westwell

[11] Patent Number: 4,722,151

[45] Date of Patent: Feb. 2, 1988

[54] AIRTIGHT DOOR ASSEMBLY

[76] Inventor: Leonard W. Westwell, 465 Duchess Avenue, Apartment #2, Ottawa, Ontario, Canada, K2A 1Y4

[21] Appl. No.: 945,932

[22] Filed: Dec. 23, 1986

[30] Foreign Application Priority Data

Nov. 27, 1986 [CA] Canada ..... 525124

[51] Int. Cl.[4] ..... E06B 7/16; E05C 19/00

[52] U.S. Cl. ..... 49/477; 49/14; 49/61; 49/394

[58] Field of Search ..... 49/477, 394, 13, 14, 49/61

[56] References Cited

U.S. PATENT DOCUMENTS

| | | | |
|---|---|---|---|
| 3,347,200 | 10/1967 | Mege | 49/477 X |
| 3,747,275 | 7/1973 | May et al. | 49/477 |
| 4,073,521 | 2/1978 | Mena | 49/477 X |
| 4,284,980 | 8/1981 | Hoinski | 49/13 X |
| 4,304,070 | 12/1981 | Musacchia | 49/13 X |
| 4,335,075 | 6/1982 | Kackos | 49/477 X |
| 4,426,358 | 1/1984 | Johansson | 49/394 X |
| 4,441,278 | 4/1984 | Covey, III | 49/477 |
| 4,631,876 | 12/1986 | Saum | 49/477 X |

*Primary Examiner*—Philip C. Kannan
*Attorney, Agent, or Firm*—Jordan and Hamburg

[57] ABSTRACT

There is provided a new and useful airtight door assembly comprising a door; an inflatable seal disposed around the perimeter of the door and including means for connecting the seal to a compressed fluid supply; a pneumatic door locking device including means for connecting the device to a compressed fluid supply; and means for simultaneously charging the compressed fluid to the seal and the locking device through the means for connecting.

17 Claims, 8 Drawing Figures

AIRTIGHT DOOR ASSEMBLY

This application relates to airtight door assemblies.

BACKGROUND OF THE INVENTION

There are many situations in which airtight doors are necessary to separate two environments. These range from domestic applications such as in refrigerator doors through various commercial and institutional applications. In the last category various types of isolation units such as those in hospitals and research establishments may have particularly strict requirements. One such example of a use in research occurs in virus studies where particular environments exposed to viruses under study must be isolated.

Many solutions have been proposed which are aimed at ensuring the integrity of airtight door seals. In this regard attention has been paid to the seals per se and to some degree to control systems and devices to improve reliability and safety.

To date no airtight door is available which adequately meets the reliability and safety requirements which have become more stringent over the years.

It is against this background that the present invention arises. An airtight door assembly has been devised which is relatively simple in concept but achieves a very high standard of reliability and safety.

PRIOR ART

Canadian Pat. No. 802,071, which issued Dec. 24, 1968, to Ganzinotti, et al., relates to a system in which fluid pressure appears to be used to power opening and closing of the door itself. The control system will not permit inflation of an inflatable seal until the door is closed and locked; and will not allow the door to open until the seal is deflated.

Canadian Pat. No. 986,368, issued Mar. 30, 1976, to May, et al., relates to an inflatable door seal for a railway freight car. In that case the movement of the door itself in closing acts through a bellows to compress air to subsequently inflate a seal for the door.

Canadian Pat. No. 1,147,602, issued June 7, 1983, to Janke, relates to an inflatable seal for windows or doors in which fluid is manually pumped from a reservoir to inflate the seal.

U.S. Pat. No. 3,769,750, granted Nov. 6, 1973, relates to an earlier arrangement of the type described in Janke above.

SUMMARY OF THE INVENTION

The invention provides an airtight door system comprising a door; an inflatable seal disposed around the perimeter of the door and including means for connecting the seal to a compressed fluid supply; a pneumatic door locking device including means for connecting the device to a compressed fluid supply; and means for simultaneously charging the compressed fluid to the seal and the locking device through the means for connecting.

GENERAL DESCRIPTION

As can be seen from the prior art, the concept of utilizing an inflatable seal for an airtight door is one which is known in the art. The present invention utilizes such an inflatable seal with a unique air distribution system to provide an airtight door assembly having a high margin of safety and reliability.

The compressible fluid supply, generally compressed air, is routed through a three-way valve with a single control lever to supply compressed air substantially simultaneously to inflate the seal and to lock the door.

The locking device comprises a member which is movable between an unlocked and a locked position responsive to the pressure of the compressed air. The locking device in the absence of compressed air is biased toward the unlocked position. In the preferred case the locking device comprises a cylinder and rod such that in the absence of air pressure the rod is biased to a retracted position and when activated by compressed air is extended to engage the door frame to lock the door.

The door is prevented from being closed with the seal inflated, because the extended locking rod will bring up against the edge of the door frame before potential damage can be done to the prematurely inflated seal.

A proximity switch is preferably provided in association with the door frame and positioned to be activated by the locking rod when in the extended position. The switch is connected to indicating devices which may indicate that the door is locked and the seal inflated or that the seal is deflated. The latter is a particularly important aspect. In normal operation, when the door is closed and compressed air charged to the locking device and the seal, the locking rod approaches the proximity sensor to activate a circuit containing an indicator such as a light. Illumination of the light indicates that the door is locked and the seal inflated.

An important interaction associated with the proximity switch but which is not strictly speaking a part of the invention is a connection between that switch and an air extraction system. It is highly preferred that a negative pressure exist on the contaminated side of the door, so that when the door seal is broken or the door open, there will be a flow of air into the contaminated room to thereby prevent outward flow of contaminants. The proximity switch is therefore electrically connected to turn on a set of fans whenever the switch is deactivated by unlocking of the door. The air flow is drawn by the fans through a set of HEPA filters. In this way contaminants are controlled when the door is not sealed.

In the preferred case a manual safety device is engaged in the locking device which upon loss of air pressure will allow the locking rod to retract sufficiently to break the circuit with the proximity switch but insufficiently to allow the door to unlock. In this mode the proximity switch assumes part of a circuit leading to a second indicator device which indicates that air pressure has been lost and the seal deflated.

Such a safety device may comprise a bore through the locking rod and a pin inserted in the rod which will allow a certain amount of retraction of the rod but will then bring up against the cylinder. In this situation, even though the air pressure has been lost, the door will remain locked. This is of particular importance where the door is used to isolate a room containing animals as in animal disease research.

A further aspect which is preferred for use in the assembly is the presence of a second proximity switch connected to an indicator for indicating when the door is in the closed position. Once the indicator is activated by the proximity switch, an operator knows that the compressed air can be charged to inflate the seal and lock the door. This is of particular importance where the door is used as an emergency exit door from a building. Such doors would not be provided with controls on the outside, so locking and seal inflating would normally be done remotely. This second proximity switch can thus be used to indicate in a remote control room that the door is closed and ready to be sealed and locked.

A further preferred feature in a number of situations, such as those where air tight doors are provided on both sides of a changing-in and changing-out room, is the provision of an interlock system. For example, where a worker emerges from a contaminated room to a shower decontamination room, it is required that the airtight door between the decontamination room and an uncontaminated room be kept closed until decontamination procedures are complete. An interlock solenoid valve may thus be operated by the locking device to prevent deflation of the door seal on either decontamination room door by normal unlocking procedures, so that no inadvertent opening of the door can take place. Separate switches would be provided to deactivate the solenoid, thus again ensuring against inadvertent opening. Various other wiring configurations for activating and deactivating an interlock system can be devised.

The control handle is preferably provided with a manual safety lock which may simply take the form of an interference member preventing movement of the control handle.

A preferred use of the door assembly of the present invention is in isolating research areas in which viral or similar research is being undertaken. It is therefore of importance that not only the periphery of the door be sealed, but also that the door itself be constructed to rigid standards. Thus, in the preferred embodiment of the present door no fasteners, such as bolts for hinges or the like are permitted to pass through the door. The only case in which a member passes through the door is that of the control handle. The preferred arrangement for passing the handle through the door is by way of a housing containing at least two O-rings. An alternative is to seal the handle at its passage through the door by teflon seals. Otherwise, all fasteners, control units, panels and the like are secured to inserts, pads or built-up areas on the face of the door.

In order to ensure the integrity of the entire door assembly, in the preferred case a test panel is provided which is adapted to be sealingly engaged in the door frame on the side of the frame opposite to the door to thereby define an enclosed space between the panel and the door. The panel contains fittings and lines for conducting compressed air to the door assembly system, an inflatable seal around the test panel itself, and to the space between the door and the test panel. The panel is provided with temperature and pressure measuring devices.

Preferably, the panel is transparent as, for example, LEXAN*, and includes a thermometer secured to the LEXAN in the space between the panel and the door and a manometer on the outside of the panel having connection through the panel to the test space.

* Trade Mark

The test space between the panel and the door can then be charged with compressed air and the pressure and temperature differential observed to determine any movement caused by leakage.

The door assembly can thus be regularly and easily tested for sealing integrity.

BRIEF DESCRIPTION OF THE DRAWINGS

In drawings which illustrate embodiments of the invention.

Figure 1:
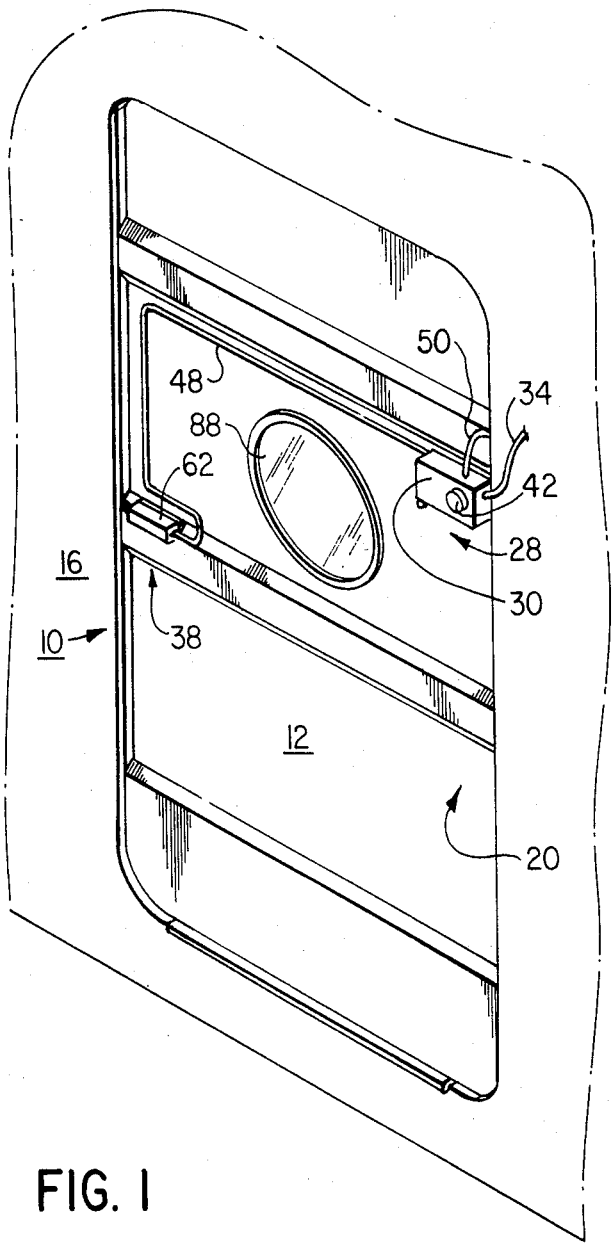
FIG. 1 is a perspective view of a door assembly according to the invention.
Figure 2:
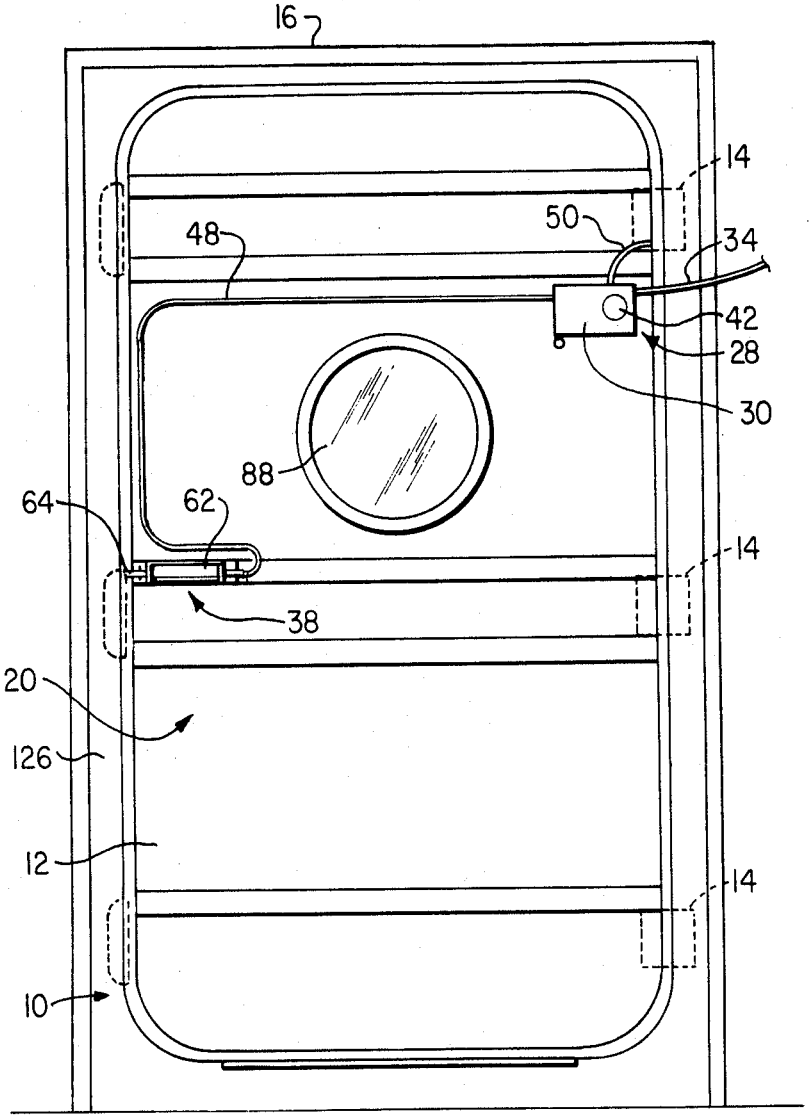
FIG. 2 is a front elevation of a door assembly according to the invention.
Figure 3:
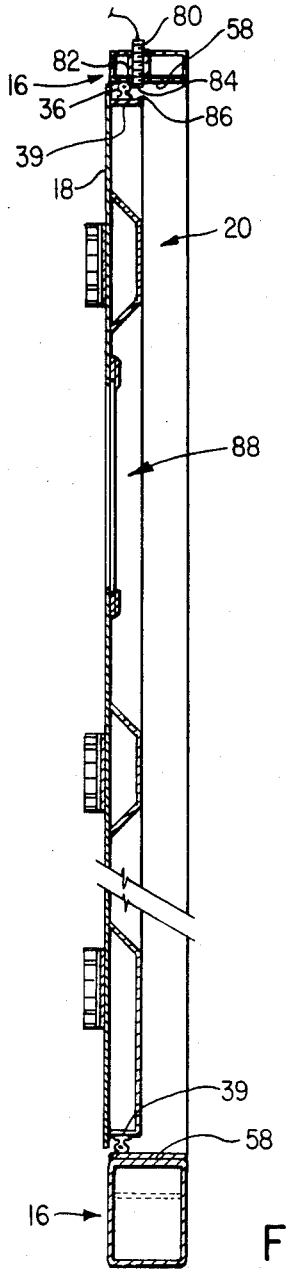
FIG. 3 is a vertical section through a door assembly according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The door assembly 10 comprises a steel plate door 12 hung on a set of three hinges 14 in the door frame 16.

In the normal use situation, the inner or backside 18 of door 12 would face the contaminated area and the front side 20 of door 12 would face outwardly from the contaminated area. Frequently the doors will be used in pairs on either side of a decontamination room which is interposed between contaminated and uncontaminated areas. In that situation the outer or front sides 20 of the doors would both face the decontamination room. All pneumatic and electrical connections, control units and the like are located on the front side 20 of door 12, with the exception that a single control handle may extend through the door.

The backside 18 of door 12 will normally be provided with a door pull 22, preferably of stainless steel, for purposes of manipulation of the door from the contaminated side. In order to avoid any escape of contaminants, the door pull 22 is mounted on a pair of steel studs 24 which are in turn secured in stainless steel anchors 26. The anchors are welded by continuous airtight welds in position on door 12.

Apart from the door pull 22 and a small control handle, the back side or contaminant facing side of the door is smooth steel plate. This offers advantages in cleaning and, as well, in the case of use on animal holding rooms, presents no components which might be damaged by kicking, butting or the like nor, conversely, which might cause injury to the animals.

Further in this regard, the clearance between the edge of door plate 12 and the frame 16 is preferably such as will prevent ingress of an animal's horn tip which could rupture the seal, but will allow ingress of a decontamination solution nozzle.

A control unit 28 is secured on the front side 20 of door 12 by means of an anchor arrangement (not shown) similar to that used with handle 22 described above. The unit 28 is essentially a valve 32 interposed on air supply line 34 for controlling ingress and egress of compressed air or other compressible fluid to inflatable seal 36 and locking device 38. The unit 28 is contained within a cover 30.

Figure 4:
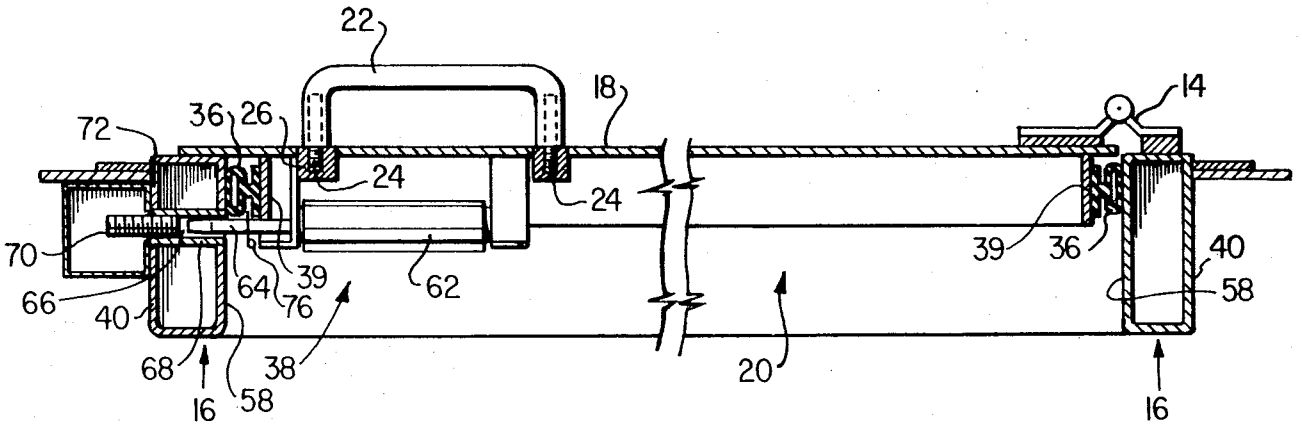
FIG. 4 is a horizontal section through a door assembly according to the invention.
Figure 5:
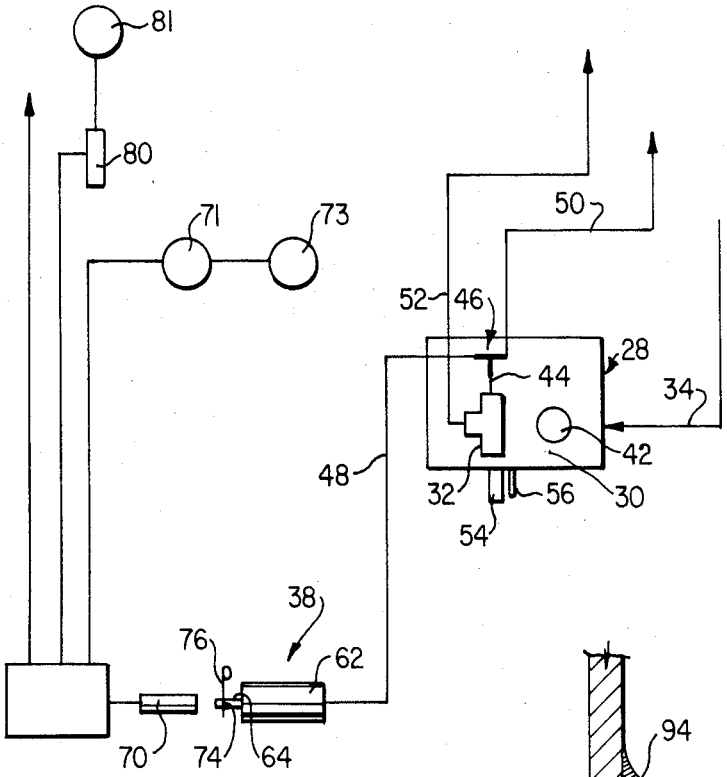
FIG. 5 is a sketch of the control system for the door assembly according to the invention.
Figure 6:
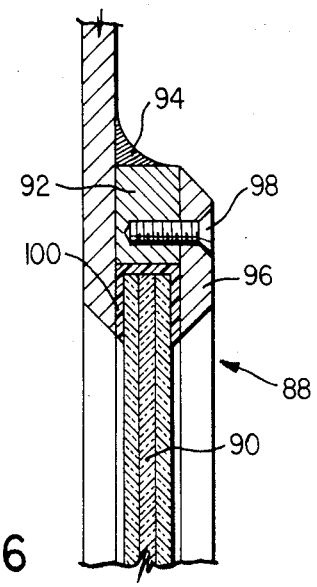
FIG. 6 is a section through part of a viewing port utilized in the invention.
Figure 7:
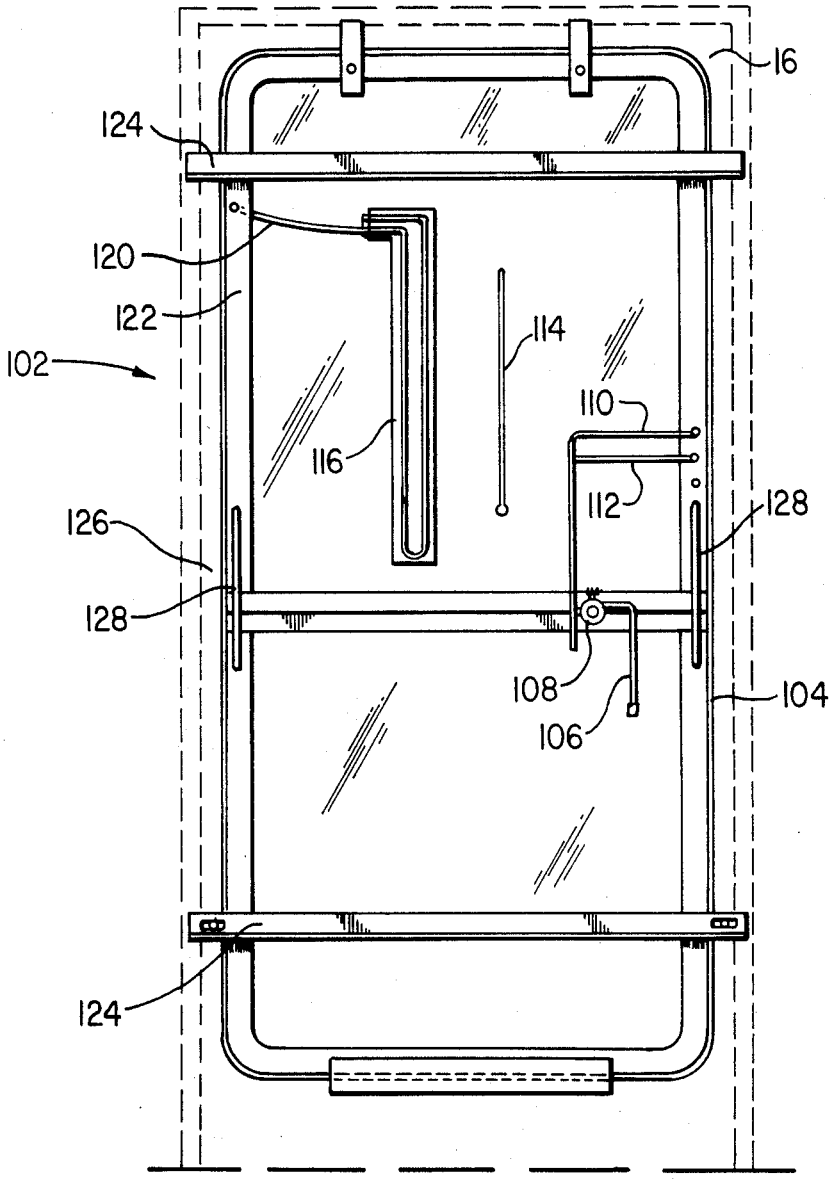
FIG. 7 is a front elevation of a test panel assembly for use with the invention.
Figure 8:
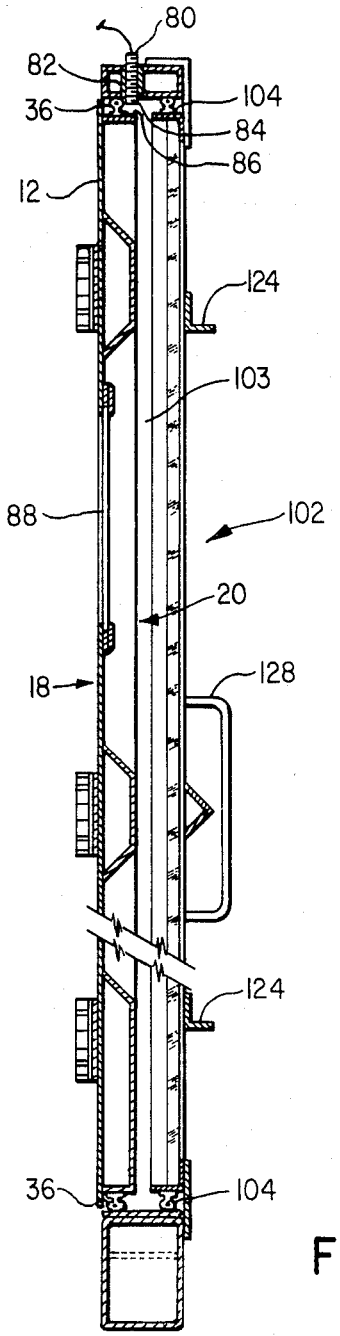
FIG. 8 is a vertical section through the door and panel assembly of FIG. 7.

As illustrated, the inflatable seal 36 is secured to sides 39 of door 12 and is of course secured around the entire periphery of the door. While this is a preferred configuration, the inflatable seal could also be secured to the door frame 16. As, for example, on vertical frame members 40 in FIG. 4. It is felt that the control of the assembly is facilitated and wear and tear on the door is greatly reduced where the seal is attached to the door rather than the door frame.

The air supply line 34 leads into the control unit 28 directly to the valve 32. An air pressure gauge 42 is preferably operatively connected to the supply line 34 and is conveniently mounted on the side of the control unit 28.

The inlet to valve 32 is via the air supply line 34. A first valve outlet 44 leads into a T-junction 46. From the T-junction 46 a first line 48 leads to the locking device 38 and line 50 leads to inflatable seal 36. The outlet 44 is at the line pressure of line 34 when the door is locked.

A second valve outlet 52 is a pressure release line through which the seal 36 can be deflated and the locking device 38 released.

In situations where it is required to interlock operation of the door with other doors as in the decontamination room example discussed above, it is convenient to utilize the exhaust line 52. Means can be provided, such as a solenoid valve, to prevent exhaustion through line 52 to thereby prevent deflation of seal 36 and unlocking by device 38.

It is assumed that there is a continuous supply of compressible fluid, as indicated, preferably compressed air, available via the air supply line 34. The operation of the valve 32 for controlling the supply of compressed air to the seal 36 and locking device 38 is by means of a single control handle 54. The handle 54 is movable manually between a first position in which the valve is open to admit compressed air from the supply line and a second position in which the valve is closed to the compressed air supply line and the pressure downstream of the valve is released. For purposes of clarity the first position of the valve will hereinafter be referred to as the lock position and the second position as the unlock position. In the lock position, compressed air from supply line 34 is admitted to the valve outlet 44. In the unlock position, the compressed air supply from line 34 is cut off, and the pressure in the system downstream of the valve is released via line 52.

A manual safety lock 56 is provided to prevent inadvertent movement of the control handle 54 from the lock to the unlock position. The safety lock 56 can, for example, be a simple spring loaded pivoted lever which can be pivoted across the path of movement of control handle 54 to prevent movement of that handle.

The operation of the inflatable seal 36 is very straight forward. When the door is closed and the air control handle moved to the lock position, compressed air is led to the inflatable seal via the line 50. The seal then inflates against the inner surface 58 of the door frame 16. In a case where the seal is fixed to the inner surface 58, then inflation of the seal causes sealing contact with the edge 39 of the door 12.

At the same time compressed air is directed via line 48 to the locking device 38. The locking device 38 may comprise any suitable compressed fluid actuated mechanism. However, a preferred configuration comprises a pneumatic cylinder 62 having therein a piston (not shown) connected to the locking rod 64. Also located within the cylinder 62 is a biasing device, preferably a spring, which biases the piston and the rod 64 toward a retracted position. When air is charged to the pneumatic cylinder 62 from the valve 32, the compressed fluid overcomes the force of the biasing spring and forces the piston and rod 64 into the extended position. A mating opening 66 is provided into and through the frame 16. The opening is preferably defined by a stainless steel sleeve 68. Therefore, in summary to this point, movement of the air control handle 54 to the lock position when the door is in a closed position will cause the inflatable seal 36 to inflate and the locking rod 64 to extend into the frame 16 to lock the door in the closed position.

To open the door the process is reversed. The control handle 54 is moved to its unlock position to close the valve 32 to cut the air supply from line 34. The pressure is released downstream of the valve through line 52, and the seal 36 deflates and the rod 64 retracts.

While the foregoing describes the operation of the basic door mechanism, the assembly includes additional safety devices as will now be described. A first proximity sensor or switch 70 is preferably positioned in the sleeve 68 within opening 66 in the door frame 16. The switch 70 protrudes into the sleeve 68 through the outer surface 72 of frame 16. The sensor 70 is so positioned that it senses the proximity of the rod 64 when the door 12 is in the closed and locked position. The sensor 70 is part of a conventional circuit which includes an indicator such as a light 71 to indicate to an operator that the door is in the closed and locked position with the seal 36 inflated.

As described this far, when the door is unlocked with the seal deflated and the rod 64 retracted, the indicator light circuit would be broken and the light would go out.

For additional ease of observation in a central control room, it may be preferred that the proximity switch 70 operate a pair of lights. For example, a green light may be activated when the door seal is in the inflated position and the proximity switch activated, and a red light activated when the proximity switch is deactivated by deflation of the seal and withdrawal of the locking rod 64.

In the preferred case, however, an additional safety factor is built into the locking device 38 to prevent the door from unlocking where pressure is lost in the supply line 34, or by leakage or similar malfunction. In the case of the illustrated locking device 38, the rod 64 is provided with a bore 74 through which a pin 76 may be manually inserted when the rod is in the extended position. Upon a loss of pressure, the rod 64 can then only retract to the point where the pin 76 brings up against the face 78 of cylinder 62. Alternatively, any suitable stop for the pin may be arranged in front of cylinder 62 while still allowing required movement of rod 64. The bore 74 and pin 76 are so located that upon loss of pressure the rod 64 will retract sufficiently to break the circuit with the proximity sensor 70 while remaining partially within the sleeve 68 so that the door remains locked. In this situation again by conventional circuitry an indicator 73 in the proximity sensor circuit will indicate the loss of air pressure.

A second proximity sensor may be utilized with the door which is of particular importance when employed on an emergency exit from a contaminated building to the outside or in similar situations. In those situations the door will have no exterior control handle and is preferably relockable from a remote control room. The second proximity switch will be activated when the door is closed to signal the control room that the seal can be inflated and the door locked. The second proximity sensor 80 is positioned in a sleeve 82 passing through the frame 16. That sensor is so positioned that the end 84 of sensor 80 will lie opposite an exposed section 86 of the side of door 12. Therefore, when the door 12 is in the closed position the proximity sensor 80 will activate a circuit leading to a indicator light 81 to indicate that the door is closed and that the sealing and locking mechanism can be activated.

The door 12 may also be provided with a viewing port 88. Because of the strict requirement that no fasteners may penetrate the door, the glazing 90 for port 88 is set into a retaining ring 92 which is secured to the door 12 by a continuous air-tight weld 94. The glazing 90 is retained within the ring 92 by a glazing ring 96 secured by screws 98. The glazing 90 is sealed with silicone as illustrated at 100.

In order to test the sealing integrity of the complete door assembly 10, including not only the inflatable seal 36, but also all other aspects of the assembly, a test panel 102 is preferably provided. The panel 102 is adapted to be secured within the door frame 16 to define a closed space 103 between panel 102 and door 12. The panel 102 is preferably provided with an inflatable seal 104 similar to seal 36. The panel 102 is provided with a connection 106 for connection to the air supply line 34. The connection 106 includes a pressure gauge 108. From the connection 106 lines 110 and 112 are provided. Line 110 replaces the air supply line 34 in connection to the control unit 28 of the door 12. The line 112 is connected to the inflatable seal 104. A thermometer 114 is preferably secured to or suspended from the inner surface of the panel 102. In the preferred case the panel 102 is constructed mainly of transparent LEXAN and so no viewing port is necessary to view the thermometer 114 for temperature change during testing procedures.

Secured to the outer surface of the panel 102 and connected by an air line to the space 103 between the panel 102 and the door 12 is a device for observing the pressure and change of pressure within the space 103. The device is preferably a manometer 116 connected to the interior space 103 by the air line 120 which passes through the frame 122 of panel 102.

The panel 102 for use is manually lifted into place and secured laterally by a pair of supports 124 which are bolted to the adjacent surfaces 126 of frame 16. A pair of handles 128 are provided to facilitate lifting the panel into place.

Any conventional valve is then utilized to admit air via connection 106 to inflate the seals 36 and 104, and the pressure and any change in the pressure and temperature can be read from observations of the thermometer and manometer. Clearly, the pressure in the space 118 could be read, displayed and recorded by conventional electronic means, but the economics of the situation would generally suggest that the additional expense would not be justified.

Thus it is apparent that there has been provided in accordance with the invention an airtight door assembly that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An airtight door assembly comprising:

a door;

an inflatable seal disposed around the perimeter of said door and including means for connecting said seal to a compressed fluid supply;

a pneumatic door locking device including means for connecting said device to a compressed fluid supply; and means for simultaneously charging said compressed fluid to said seal and said locking device through said means for connecting.

2. The door assembly of claim 1 wherein said means for connecting comprise fluid lines connecting said seal and said locking device to a fitting, and wherein said fitting includes means for connecting said fitting to a fluid supply.

3. The door assembly of claim 2 in which said means for charging comprises a valve selectively movable from a closed position in which pressure is released from said seal and said locking device to an open position in which fluid is charged to both of said seal and said locking device.

4. The door assembly of claim 3 wherein said assembly includes a door frame and wherein said locking device comprises a member movable when charged with fluid under pressure to a lock position in engagement with said frame and movable in the absence of said fluid under pressure to an unlock position.

5. The door assembly of claim 4 in which said member is biased in the absence of fluid under pressure toward the unlock position.

6. The door assembly of claim 5 in which said member comprises a rod extending from a cylinder, said rod spring biased to a retracted position in the absence of fluid under pressure and forced into an extended position in engagement with said frame when subjected to fluid under pressure.

7. The door assembly of claim 6 in which a bore is provided transversely through said rod, and a pin is manually engageable through said bore whereby said rod may be maintained in said lock position in the absence of fluid under pressure.

8. The door assembly of claim 7 in which, when said pin is engaged and pressure is released, said rod partially retracts but insufficiently to unlock said door, and wherein said frame includes therein a first proximity switch adapted to be connected to a power supply, said switch positioned to be activated by said rod when in the fully extended position and connected to at least an indicating device indicating that the seal is inflated and the door locked and an indicating device indicating that the seal is deflated.

9. The door assembly of claim 5 in which said locking device includes a manually engageable safety device whereby said member is maintained in the lock position in the absence of fluid under pressure.

10. The door assembly of claim 4 in which said frame includes therein a first proximity switch adapted to be connected to a power supply and in a position to be activated by said member when said member is in the lock position with the said seal inflated.

11. The door assembly of claim 10 wherein said assembly includes indicating devices connected to said proximity switch to indicate a door locked and seal inflated condition or a seal deflated condition.

12. The door assembly of claim 4 in which said frame includes therein a second proximity switch adapted to be connected to a power supply and positioned to be activated when the door is closed.

13. The door assembly of claim 12 in which said assembly includes an indicating device connected to said second proximity switch to indicate a door closed condition.

14. The door assembly of claim 4 including a door seal integrity test device, said device comprising a panel having a second pneumatic inflatable seal around the perimeter thereof and adapted to be secured in said frame on the side thereof opposite to said door to thereby define a space between said panel and said door in the closed position; said panel including fittings and lines for connecting to a supply of fluid under pressure and for supplying fluid under pressure to said means for connecting on said door seal and said door locking device, and to the space between said panel and said door; said panel including means for reading the pressure and temperature in said space.

15. The door assembly of claim 14 in which said panel is transparent.

16. The door assembly of claim 15 in which said means for reading pressure comprises a manometer on the outer side of said panel which is connected via a line and fitting to the space between the panel and the door.

17. The door assembly of claim 15 in which said means for reading temperature comprises a thermometer secured in said space.

* * * * *